United States Patent [19]

Carle

[11] 4,240,326

[45] Dec. 23, 1980

[54] HYDRAULIC VIBRATION EXCITER AND METHOD OF COOLING THEREOF

[75] Inventor: Udo Carle, Höhr-Grenzhausen, Fed. Rep. of Germany

[73] Assignee: Koehring GmbH - Bomag Division, Boppard, Fed. Rep. of Germany

[21] Appl. No.: 50,782

[22] Filed: Jun. 21, 1979

Related U.S. Application Data

[63] Continuation of Ser. No. 769,925, Feb. 18, 1977, abandoned.

[30] Foreign Application Priority Data

Feb. 23, 1976 [DE] Fed. Rep. of Germany ..... 2607190

[51] Int. Cl.[3] ..... F15B 21/02

[52] U.S. Cl. ..... 91/39; 60/456; 91/234; 91/243; 91/401

[58] Field of Search ..... 60/456, 464, 543, 571, 60/567, 592; 91/35, 39, 165, 234, 274, 277, 325, 401, 243, 408; 92/86, 86.5, 87, 142, 160

[56] References Cited

U.S. PATENT DOCUMENTS

| | | | |
|---|---|---|---|
| 2,681,116 | 6/1954 | Treseder | 91/39 |
| 3,058,450 | 10/1962 | Lissau | 91/401 |
| 3,242,675 | 3/1966 | Norton | 60/543 |
| 3,601,009 | 8/1971 | Burgess, Jr. | 91/234 |
| 3,849,986 | 11/1974 | Vural | 60/537 |
| 3,866,421 | 2/1975 | Kersten | 60/464 |
| 3,925,987 | 12/1975 | Faisandier | 60/456 |

*Primary Examiner*—Abraham Hershkovitz
*Attorney, Agent, or Firm*—Spencer & Kaye

[57] ABSTRACT

A hydraulically operated vibration exciter for a vibrating compactor of the kind comprising a piston in a cylinder, the piston and cylinder being arranged to move to and fro relative to each other, a source of liquid under pressure, a pressure line connecting the source to the cylinder and means for causing the liquid to move to and fro between the source and the cylinder to bring about the relative movement between the piston and cylinder is cooled by a method in which, during the relative movement, a quantity of the liquid is withdrawn from the cylinder and this quantity is not returned to the cylinder in the subsequent stroke, but is replaced by a fresh quantity of liquid at a lower temperature. To enable this cooling method to be carried out, an exciter of the kind just described is provided with a duct which leads from at least one of the end faces of the piston to an opening in the peripheral face of the piston, and the cylinder is provided with an opening in its wall with which the opening in the peripheral face of the piston comes into communication intermittently during the to and fro relative movement, the opening in the wall of the cylinder being connected by a liquid withdrawal line to a liquid reservoir.

7 Claims, 8 Drawing Figures

HYDRAULIC VIBRATION EXCITER AND METHOD OF COOLING THEREOF

CROSS REFERENCE TO RELATED APPLICATION

This application is a continuation of applicant's copending United States Application Ser. No. 769,925, Feb. 18th, 1977 now abandoned.

This invention relates to methods of cooling hydraulic vibration exciters for vibrating compactors of the kind comprising a piston in a cylinder, the piston and cylinder being arranged to move to and fro relative to each other, a source of liquid under pressure, a pressure line connecting the source to the cylinder and means for causing liquid to move to and fro between the source and the cylinder to bring about the relative movement between the piston and cylinder. The invention also relates to vibration exciters of the kind which are adapted to be cooled by the methods to which the invention relates.

The invention is moreover an improvement in or modification of the invention disclosed in our prior U.S. Pat. No. 3,849,986, the disclosure of which is incorporated herein by reference.

This prior Patent Specification discloses a hydraulic exciter of vibrations for a vibratory compactor, the exciter including an exciter piston and an exciter cylinder which are relatively movable to and fro and the movable part of which is arranged to be connected to a compacting member, wherein the cylinder is connected by a conduit to a first source of hydraulic fluid the pressure of which, in use, pulsates, and wherein the cylinder is connected to at least one further source of hydraulic fluid the pressure of which, in use, pulsates and the phase of which is adjustable with respect to that of the first source.

In vibration exciters of the kind described above, it is impossible, especially during long periods of operation, to prevent the occurrence of leaks between the sliding parts of the piston and cylinder, even when these parts are carefully sealed. Such leakage losses cause the datum position or centre point of the relative movement between the piston and the cylinder to be displaced so that correct operation of the vibration exciter is no longer ensured. In addition, the liquid under pressure heats up considerably as a consequence of friction between the piston and the cylinder, especially at high reciprocating or oscillating speeds and power outputs. The liquid, since it travels to and fro in a closed circuit between the cylinder and the source, is not itself capable of conducting away this heat to the necessary extent. A sufficient removal of heat by convection and radiation to adjacent components at lower temperatures does not occur, especially in those types of exciter used in compactors for compacting bituminous materials in road construction and which are thus in contact with material at temperatures exceeding 100° C. Whereas the source of liquid under pressure, because of its physical separation from the cylinder and piston, operates at lower temperatures, the operating temperatures in the cylinder and piston can reach unacceptably high values, without temperature equalisation being possible. The increasing temperature of the pressurised liquid also results in more intense wear of cylinder seals and thus an increase in leakage rate and this in turn aggravates the undesirable wandering of the piston, that is the movement of its datum position. Further, the lubricating conditions between the sliding parts themselves deteriorate.

The aim of the present invention is to provide a method of cooling a hydraulically operated vibration exciter for a vibrating compactor, especially an exciter as disclosed in our aforementioned Patent so that unacceptably high temperatures in the cylinder do not occur in operation, even under unfavourable external working conditions, and their detrimental consequences are thus avoided. The aim is also to provide such an exciter which is adapted to be cooled in operation and is thus improved.

Thus according to one aspect of this invention, we provide a method of cooling a hydraulically operated vibration exciter for a vibrating compactor, the exciter comprising a piston in a cylinder, the piston and cylinder being arranged to move to and fro relative to each other, a source of liquid under pressure, a pressure line connecting the source to the cylinder and means for causing liquid to move to and fro between the source and the cylinder to bring about the relative movement between the piston and cylinder, wherein during the relative movement a quantity of the liquid is withdrawn from the cylinder and this quantity is not returned to the cylinder in the subsequent stroke, but is replaced by a fresh quantity of liquid at a lower temperature.

According to another aspect of the invention, we provide a method of cooling a hydraulic exciter of vibrations for a vibratory compactor, the exciter including an exciter piston and an exciter cylinder which are relatively movable to and fro and the movable part of which is arranged to be connected to a compacting member, wherein the cylinder is connected by a conduit to a first source of hydraulic fluid the pressure of which, in use, pulsates, and wherein the cylinder is connected to at least one further source of hydraulic fluid the pressure of which, in use, pulsates and the phase of which is adjustable with respect to that of the first source, in which method during the relative movement a quantity of the liquid is withdrawn from the cylinder and this quantity is not returned to the cylinder in the subsequent stroke, but is replaced by a fresh quantity of liquid at a lower temperature.

The invention also consists in a vibration exciter for a vibrating compactor adapted to be cooled by a method in accordance with the first aspect of the invention and comprising a piston in a cylinder, the piston and cylinder being arranged to move to and fro relative to each other, a source of liquid under pressure, a pressure line connecting the source to the cylinder and means for causing liquid to move to and fro between the source and the cylinder to bring about the relative movement between the piston and cylinder, wherein a duct leads from at least one of the end faces of the piston to an opening in the peripheral face of the piston, and the cylinder is provided with an opening in its wall with which the opening in the peripheral face of the piston comes into communication intermittently during the to and fro relative movement, the opening in the wall of the cylinder being connected by a liquid withdrawal line to a liquid reservoir.

The invention further consists in a hydraulic exciter of vibrations for a vibratory compactor adapted to be cooled by a method in accordance with the second aspect of the invention and including an exciter piston and an exciter cylinder which are relatively movable to and fro and the movable part of which is arranged to be connected to a compacting member, wherein the cylinder is connected by a conduit to a first source of hydraulic fluid the pressure of which, in use, pulsates, and wherein the cylinder is connected to at least one further source of hydraulic fluid the pressure of which, in use, pulsates and the phase of which is adjustable with respect to that of the first source, characterised in that a duct leads from at least one of the end faces of the piston to an opening in the peripheral face of the piston, and the cylinder is provided with an opening in its wall with which the opening in the peripheral face of the piston comes into communication intermittently during the to and fro relative movement, the opening in the wall of the cylinder being connected by a liquid withdrawal line to a liquid reservoir.

This construction of the vibration exciter makes it possible to determine exactly when or at what position of the piston in the cylinder the pressurised cylinder chambers will be connected to a flushing system to enable the quantity of pressurised liquid at high temperature to be removed from the cylinder and be replaced by a corresponding quantity of cool liquid. The quantity of liquid to be removed can be adjusted so that a uniform temperature is always maintained in the cylinder. Generally the temperature in the cylinder is kept the same as the temperature of the pressurised fluid source. In this way, an unacceptably high heating up of the vibration exciter is reliably prevented.

In one preferred embodiment of the invention, at least one duct leads from each of the end faces of the piston, the duct or ducts leading from each of the end faces communicating with a separate annular groove in the peripheral face of the piston. The provision of annular grooves offers the advantage that the connection between one duct and the opening through the cylinder associated with it and leading to the liquid withdrawal line is dependent solely upon the position of the piston in the axial direction, and not upon its rotational position in the cylinder.

One advantageous embodiment of the invention consists in the feature that at least one sleeve is provided between the piston and the cylinder, said at least one sleeve having an opening through its wall and being adjustable in position axially in the cylinder and either the sleeve being formed in its outer peripheral surface with an axially extending groove, into which the opening through the wall of the sleeve leads, or the internal surface of the wall of the cylinder being provided with an axially extending groove from which the opening in the wall of the cylinder leads, the groove in the sleeve or in the cylinder remaining in communication with the opening in the wall of the cylinder or the wall of the sleeve respectively as the sleeve is adjusted in position in the cylinder. By sliding and/or rotating the sleeve, the centre of reciprocation or oscillation of the piston can be displaced relative to the cylinder and/or the alignment between the ducts of the piston and the openings in the cylinder can be laterally displaced. The control obtained may be further increased if, instead of one single sleeve, two mutually independent sleeves are used.

According to a further embodiment, a liquid flow control or regulating valve is provided in the liquid withdrawal line. The control or regulating valve enables the pressurized liquid to be supplied or removed in a time-dependent and/or a volume-dependent manner. The valve may be actuated at each stroke or after a number of strokes by pulses regulated by the cylinder and/or piston itself and/or by external pulses and thereby initiate the withdrawal of a certain quantity of heated pressurised liquid. A common feature of all variants is that the quantity of liquid removed in any stroke which is small in relation to the swept volume of the piston is always made up either on the pressure-generating side of the piston or in the circuit itself, in order to complete the exchange cycle and to prevent the wandering of the piston from its datum position. The supply of the replacement liquid is preferably done by a feed device, itself of known type and consisting of a feed pump and a valve system which supplies the pulsating liquid flow, at a suitable point at that instant at which the pressure has dropped below a certain value.

Some examples of methods and of vibration exciters in accordance with the invention will now be described with reference to the accompanying diagrammatic drawings, in which.

Figure 1:
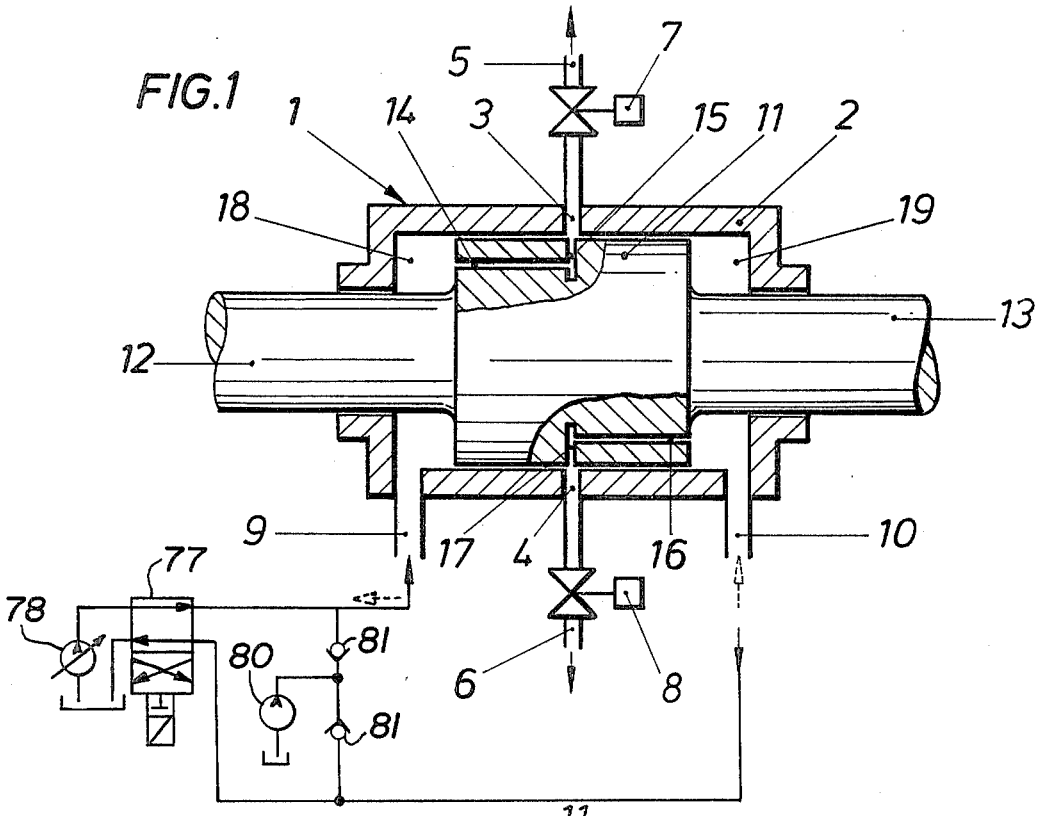
FIG. 1 is a longitudinal section through one example of the exciter having a double-acting, rotationally fixed piston.

In the example of FIG. 1, a piston 11 is longitudinally reciprocable in a cylinder 1, but is rotationally fixed by means of guide components, not shown. A left-hand cylinder chamber 18 is connected via a line 9 and a right-hand cylinder 19 is connected via a line 10, with a source of liquid under pressure, not shown, which produces the liquid flow necessary to drive the piston 11. By infinitely adjustable regulation of the liquid flow in the pressure source, it is possible for the piston 11 to execute strokes ranging from zero up to the peak value corresponding to the maximum liquid flow available. Leaks occurring at the sealing points between the cylinder 1 and piston rods 12 and 13 would, since in practice they are not of the same size, together with further internal leaks between the piston 11 and the cylinder 1 result in a progressive wandering of the datum position of the piston 11. In order to prevent this and in addition to prevent an undesired temperature rise inside the cylinder, the piston 11 has two ducts 14, 15 and 16, 17. The ducts 15 and 17 lead out to the cylinder wall 2 and this in turn is provided, preferably in its central region, with openings 3 and 4. The openings 3 and 4 communicate via throttle and/or shut-off valves 7 and 8 and via lines 5 and 6, with a reservoir, not shown, of the liquid source, also not shown. If the piston moves, for example, from left to right, then at the instant at which the duct 15 is in alignment with the opening 3, a quantity of liquid which has become heated and the volume of which is dependent upon the pressure existing in the cylinder space 18 is conducted away to the reservoir. As a result, the piston movement is somewhat delayed and simultaneously the liquid column in the cylinder space 19 is depressurised as far as the pressure source, so that the volume of liquid which is also lost from the chamber 19, as a consequence of the flushing out of the chamber 18, is made up by fresh liquid by means of a feed or make-up device. The same thing happens again when the piston movement is reversed.

If now, in addition to the alternating flushing of the chambers 18 and 19, the initially mentioned wandering of the datum position of the piston due to differing leakage rates occurs, then the centre of reciprocation of the piston 11 moves away from the passages 3 and 4 towards the side of greater leakage. Since the piston, because of the characteristic of the pressure source, reciprocates with a sinusoidal or approximately sinusoidal motion, a higher pressure now exists in this case, when the openings in the piston and the cylinder overlap, on the side of the cylinder chamber which has increased in volume due to the leakage than with the opposite stroke movement. As a result, a greater quantity of flushing liquid is removed from the side of the chamber of increased volume than from the opposite side and thus equilibrium is automatically reinstated, that is to say the centre of reciprocation of the piston is restored to its initial position. The throttle valves 7 and 8 serve for regulating or shutting-off the flow of flushing liquid preferably during starting up of the exciter, in order for example to attain the optimum operating temperature rapidly.

As noted earlier herein this invention relates to improvements in the invention disclosed in U.S. Pat. No. 3,849,986 and the exciter pistons of the present invention can be driven in the manner disclosed in that patent. Thus, as is shown in FIG. 1, in order to drive the exciter piston at a controlled frequency and with a controllable stroke, each of lines 9 and 10 can be connected through a control valve 77 to a hydraulic pressure pump 28 which is driven by a suitable motor. The pump 78 has a suction side connected to a hydraulic fluid reservoir and the control valve 77 has a discharge port leading to the same reservoir.

The valve 77 is operated by a variable speed control motor which continuously alters the porting of the valve 77 so that alternately the space on one side of the piston 11 is connected through the valve 77 to the outlet side of pump 78 and the space at the other side of piston 11 is connected through the valve 77 to the reservoir. When valve 77 is shifted, the above-described connections are reversed.

Thus, the frequency of cyclic movement of the piston is directly controlled by the frequency of switching of valve 77, while the rate of delivery of hydraulic fluid during each operating cycle is controlled by the rate of delivery of liquid by pump 78.

In order to replenish liquid withdrawn via lines 5 and 6, there can be provided, in a manner known in the art, a feeder pump 80 having its suction side connected to a reservoir and its pressure side connected to two check valves 81 each connected to a respective one of lines 9 and 10 to permit liquid to flow only in the direction from pump 82 to each of lines 9 and 10. Since the pressure in each conduit between valves 77 and each of lines 9 and 10 undergoes a cyclic variation, it is only necessary to select the output pressure of pump 80 to permit liquid to flow from that pump to a respective conduit when the pressure existing in that conduit is below a selected value. The time during which the pressure in the conduit is below such value will, of course, be a function of the quantity of liquid which has flowed out via line 5 and 6 during the preceding operation phase. Thus, the quantity of liquid between valve 77 and each of chambers 18 and 19 will be subjected to a continual and automatic regulation.

Figure 2:
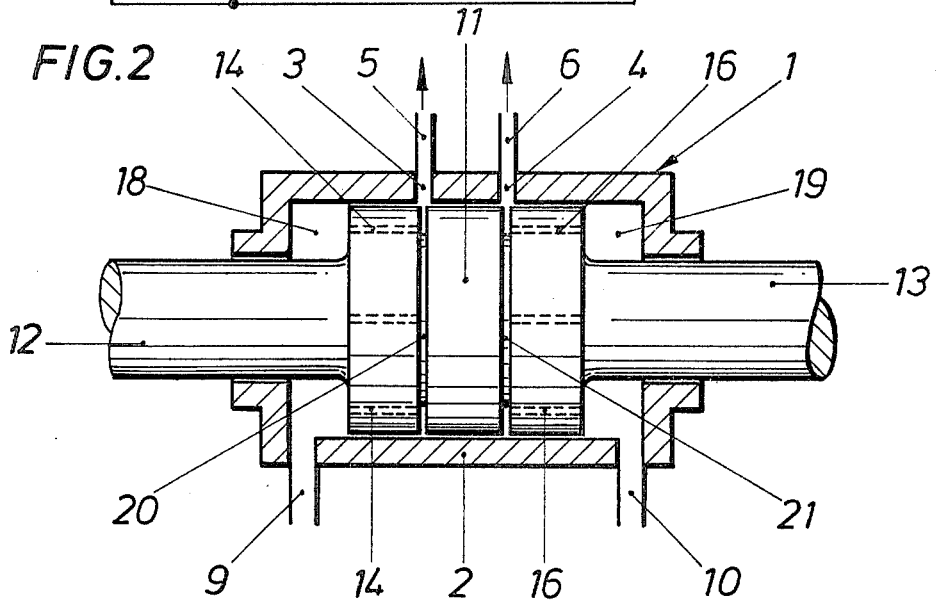
FIG. 2 is a similar view of a second example of the exciter having a double-acting, rotationally movable piston.

The example shown in FIG. 2 incorporates an extension of the flushing system shown in FIG. 1. To enable the rotational fixing between the piston 11 and the cylinder 1 to be dispensed with, ducts 14 and 16 each lead into an annular groove 20,21 respectively in the piston 11. These annular grooves 20, 21 correspond, for the same position of piston, with two lines 5 and 6 both leading from the cylinder 1.

Figure 3:
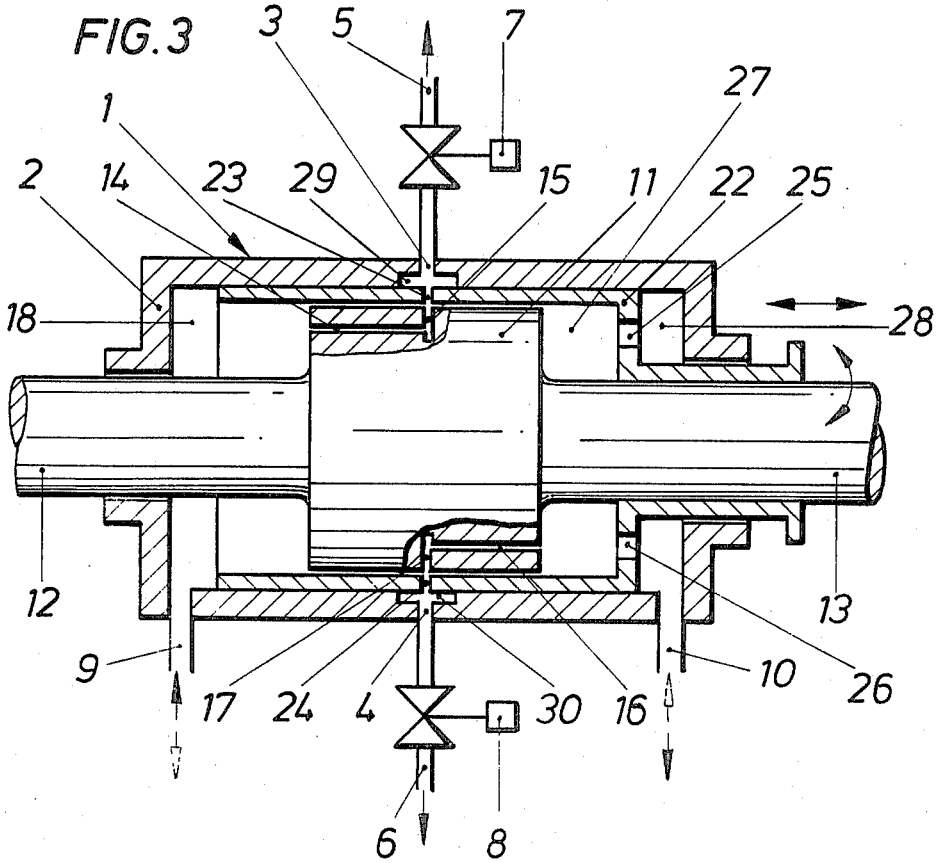
FIG. 3 is a similar view of a third example of the exciter having a sleeve which is axially displaceable between the cylinder and piston.

In the example of FIG. 3, there is additionally a cylindrical sleeve 22 comprising passages 23 and 24 situated between the cylinder wall 2 and the piston 11. This sleeve 22 serves not only as a sliding guide for the piston 11 but also as a rotatable or axially movable sleeve valve for displacing control ports between ducts 15, 17 and passages 23, 24 respectively. By displacing and/or rotating the sleeve 22 by means of actuating mechanisms of a known type which are not shown, it is thus possible for the centre of reciprocation of the piston to be adjusted relative to the cylinder 1 and/or for a lateral displacement of the overlaps of the communicating openings to be obtained. Chambers 29 and 30 respectively for collecting the flushed-out liquid are provided upstream of the openings 3 and 4 in the cylinder wall 2. The cylinder chamber 27 between the sleeve 22 and piston 11 is in communication, through openings 25 and 26, with the cylinder chamber 28 situated between the sleeve 22 and the cylinder wall 2 of the cylinder 1.

Figure 4:
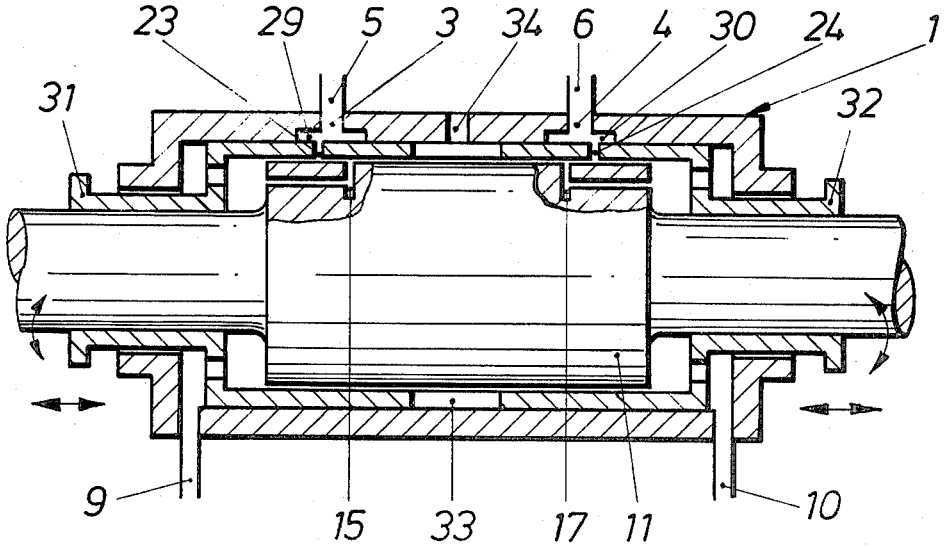
FIG. 4 is a similar view of a fourth example of the exciter having two sleeves which are axially displaceable between the cylinder and piston.

FIG. 4 shows, with similarity to the example of FIG. 3, a flushing system, which comprises two sleeves 31 and 32, instead of only one. These sleeves 31, 32 can be adjusted either quite separately or together, to permit adjustment of the volume of liquid to be flushed out and replaced, the amplitude of reciprocation of the piston 11, and the centre point of reciprocation. By appropriate adjustment of the sleeves 31, 32, it is possible to make the exchange of liquid take place either in the vicinity of the centre point of reciprocation, similarly to the examples of FIGS. 1, 2 and 3, or for the exchange to be made for each side of the piston in the vicinity of its dead-centre position. The arragement also enables the effective range of reciprocation to be adjusted. The chamber 33, produced between the sleeves 31 and 32, when they are moved apart, is in communication via one or more openings 34 with the liquid reservoir. Here again, in a manner analogous to the example of FIG. 1, throttle valves can be disposed in the lines 5 and 6 downstream of the openings 3 and 4. It is also possible for annular grooves to be used in the piston 11 instead of the ducts 15, 17, as is the case in the example of FIG. 2. In a manner analogous to FIG. 3, chambers 29 and 30 for collecting the flushed-out liquid, are provided upstream of the openings 3 and 4.

Figure 5:
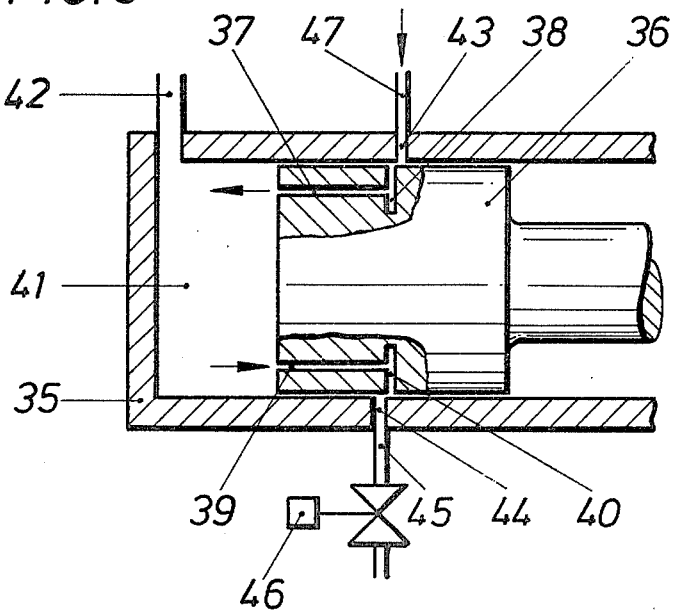
FIG. 5 is a similar view of a fifth example having a single-acting, rotationally fixed piston.

In FIG. 5, a hydraulic vibration exciter with a single-acting piston 36 is shown. This piston 36 is axially movable in a cylinder 35, but is rotationally fixed by guide components, not shown. The cylinder chamber 41 is connected via a line 42 with a liquid pressure source, not shown, which induces a reciprocating motion in the piston 36 or the cylinder 35. The piston 36 is equipped with two radially opposed ducts 37, 38 and 39, 40. Two openings 43 and 44 are situated in the wall of the cylinder 35. The opening 44 is connected to a liquid reservoir via a line 45, equipped with a throttle and shut-off valve 46. The opening 43 on the opposite side is connected via a feed line 47 to a feed device of known type which is not shown.

If, for example, the piston 36 is moving from left to right, then at the instant at which the duct 40 is aligned with the opening 44 a quantity of liquid is removed from the cylinder chamber 41 as a consequence of the working pressure acting upon the piston 36. In order to compensate for the removed volume including normal leak losses between the piston 36 and cylinder 35, fresh liquid is supplied via the feed line 47 at the instant of movement at which the working pressure falls below a certain level, especially when the piston 36 is near to the right-hand dead-centre position and the working pressure naturally drops considerably. The ducts 38 and 40 and also the passages 43 and 44 are so adapted relative to one another in regard to their position and size that a self-regulating flow compensation takes place between the removed and the supplied quantity of liquid, so that there is always a defined range of reciprocation for the piston 36.

Figure 6:
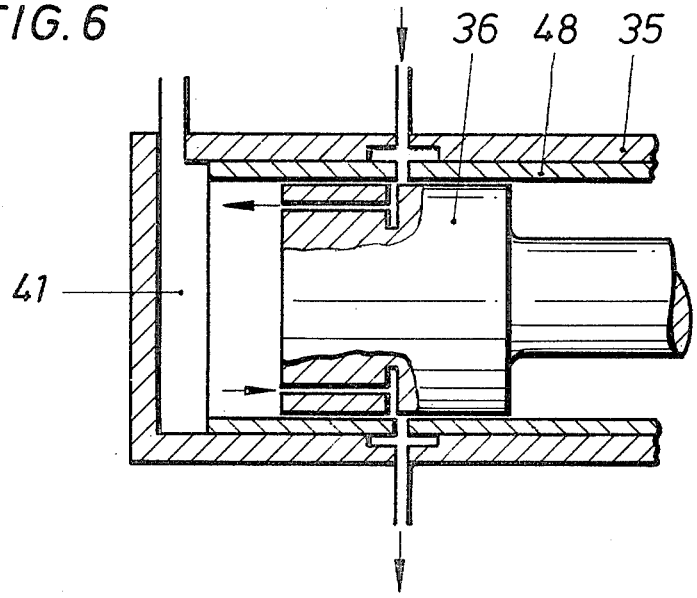
FIG. 6 is a similar view of a sixth example having a single-acting piston and a sleeve which is axially displaceable between the cylinder and piston.

The example illustrated in FIG. 6 differs from that of FIG. 5 in that a sleeve 48 is disposed between the cylinder 35 and the piston 36. The overlaps between the communicating ducts and the openings can be changed by means of the sleeve 48, so that a change of magnitude in the open cross-sections and/or a displacement of the control times is possible. This enables an adjustment to be made in the reciprocating range of the piston 36 and moreover in the quantity of liquid replaced with fresh liquid in each stroke.

In a further example of the invention, the piston 36 can be furnished with annular grooves, in order to make unnecessary the rotational fixing between the piston 36 and the cylinder 35. Finally, instead of a single sleeve 48, two sleeves may be provided, as has already been described in connection with the example of FIG. 4.

Figure 7:
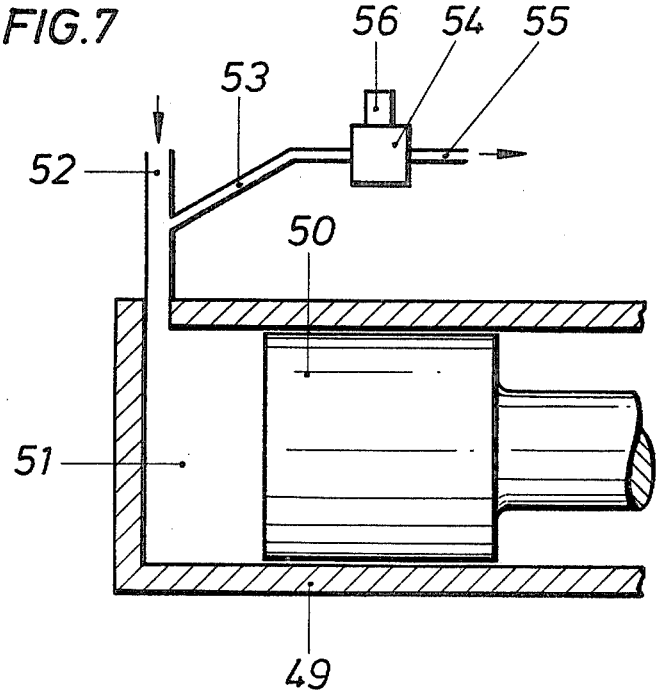
FIG. 7 is a similar view of a seventh example having a single-acting piston and a pulse-regulated valve; and, FIG. 8 is a cross-section through an eighth example of the exciter in which the piston is constructed as an oscillating vane.

In the exciter of FIG. 7 which operates in accordance with the method of the invention, a piston 50 is longitudinally guided in a cylinder 49. A cylinder chamber 51 is supplied via a line 52 with pressurised liquid from a pressure source, not shown. The line 52 is connected via a line 53 with a shut-off valve 54, from which a line 55 leads to a tank. The shut-off valve 54 is coupled for example to a magnetic switch 56, which causes a specific quantity of liquid to be removed from the cylinder chamber 51 at specific intervals of time. The make-up of fresh liquid to maintain the same stroke of the piston is carried out in the manner already described through a known feed system, it being possible for this feed to be at the pressure source itself, in the passage to the cylinder 49 or directly into the cylinder chamber 51. This principle can of course also be used with double-acting cylinders.

Figure 8:
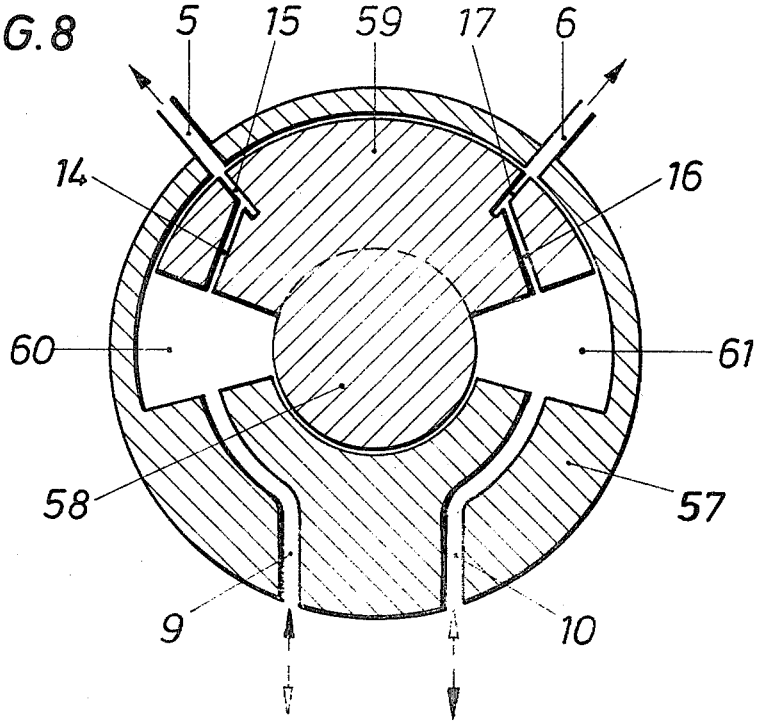

Whereas the vibration exciters according to FIGS. 1 to 7 are each constructed as linear stroke reciprocating motors, FIG. 8 shows a vibration exciter according to this invention constructed as an oscillatory motor. This oscillatory motor has a housing 57 and an oscillating piston 59, mounted on a shaft 58. The oscillating piston 59 is subjected to the action of pressurised liquid in the same manner as the pistons of the linear stroke motors. The pressurisation takes place on two sides in pressure chambers 60 and 61, which are connected by lines 9 and 10 with a pressure source, not shown. In other respects, this oscillating exciter has the feed and return lines, bearing the same references, as the linear stroke motors already described.

I claim:

1. In a hydraulically operated vibration exciter for a vibratory compactor, which exciter includes a cylinder, a piston mounted in the cylinder for reciprocating movement therein and delimiting two cylinder chambers located at respectively opposite sides of the piston, a source of hydraulic fluid under pressure communicating with the chambers for causing a liquid column of variable volume to move to and fro between the source and each chamber, the source acting to produce a cyclic reversal in the direction of liquid flow between the source and each chamber and a cyclic variation in the pressure of the liquid between the source and each chamber, for causing the piston to undergo, relative to the cylinder, a reciprocating movement with a controllable stroke, the improvement comprising means for discharging from each chamber a quantity of heated hydraulic fluid proportional to the pressure in said chamber only when said piston is in the vicinity of the center of its stroke; and means for adding a corresponding quantity of fluid at a lower temperature to the fluid supplied by said source.

2. An arrangement as defined in claim 1 wherein said discharging means comprise means defining two ducts each leading from an associated side of said piston to a respective opening in the peripheral face of said piston, means defining an opening in the wall of said cylinder, said opening in said peripheral face of said piston coming intermittently into communication with said opening in said wall of said cylinder during said to and fro relative movement, a liquid reservoir, and liquid withdrawal line means communicating said opening in said wall of said cylinder with said reservoir.

3. An exciter as claimed in claim 2, wherein there are two said ducts each leading from a respective opposite side of said piston, and two separated openings in the peripheral face of said piston, each opening having the form of an annular groove in the peripheral face of said piston, with at least one said duct communicating with one of said annular grooves and the other said duct communicating with the other of said annular grooves.

4. An exciter as claimed in claim 2, further comprising at least one sleeve interposed between said cylinder and said piston, said sleeve including a wall, means defining an opening through said wall of said sleeve, means for adjusting said sleeve axially in position in said cylinder, means defining an axially extending groove in the other peripheral surface of said wall of said sleeve, said opening through said wall of said sleeve communicating with said groove in said wall of said sleeve and said groove in said wall of said sleeve being in communication with said opening in said wall of said cylinder in all axial positions into which said sleeve is adjustable by said adjusting means.

5. An exciter as claimed in claim 2, further comprising at least one sleeve interposed between said cylinder and said piston, said sleeve including a wall, means defining an opening through said wall of said sleeve, means for adjusting said sleeve in position axially in said cylinder and means defining an axially extending groove in the internal surface of said wall of said cylinder, said groove communicating with said opening in said wall of said cylinder and said groove remaining in communication with said opening in said wall of said sleeve in all positions into which said sleeve is adjusted axially in said cylinder by said adjusting means.

6. An exciter as claimed in claim 2, further comprising liquid flow control means in said liquid withdrawal line.

7. A method of cooling a hydraulically operated vibration exciter for a vibratory compactor, which exciter includes a cylinder, a piston mounted in the cylinder for reciprocating movement therein and delimiting two cylinder chambers located at respectively opposite sides of the piston, a source of hydraulic fluid under pressure communicating with the chambers for causing a liquid column of variable volume to move to and fro between the source and each chamber, the source acting to produce a cyclic reversal in the direction of liquid flow between the source and each chamber and a cyclic variation in the pressure of the liquid between the source and each chamber, for causing the piston to undergo, relative to the cylinder, a reciprocating movement with a controllable stroke, said method comprising discharging from each chamber a quantity of heated hydraulic fluid proportional to the presence in said chamber only when said piston is in the vicinity of the center of its stroke; and adding a corresponding quantity of fluid at a lower temperature to the fluid supplied by said source.

* * * * *